United States Patent [19]

McCormick

[11] Patent Number: 4,715,379

[45] Date of Patent: Dec. 29, 1987

[54] PACIFIER

[76] Inventor: Mary D. McCormick, 4415 N. 64 St., Milwaukee, Wis. 53218

[21] Appl. No.: 901,280

[22] Filed: Aug. 28, 1986

[51] Int. Cl.[4] ..... A61J 17/00

[52] U.S. Cl. ..... 128/360; 128/359

[58] Field of Search ..... 128/359–360; D25/45–46

[56] References Cited

U.S. PATENT DOCUMENTS

| | | | |
|---|---|---|---|
| 245,335 | 7/1977 | Meeker et al. . | |
| 245,790 | 4/1977 | Meeker et al. . | |
| 248,317 | 10/1978 | Meeker et al. . | |
| 249,161 | 7/1978 | Rohrig . | |
| 3,129,709 | 4/1964 | Rountree | 128/360 |
| 4,105,032 | 6/1978 | Blomstedt . | |
| 4,493,324 | 1/1985 | Johnston | 128/360 |
| 4,554,919 | 8/1985 | Hubert . | |

FOREIGN PATENT DOCUMENTS

| | | | |
|---|---|---|---|
| 955195 | 1/1950 | France | 128/360 |
| 18109 | of 1896 | United Kingdom | 128/360 |
| 23091 | of 1902 | United Kingdom | 128/360 |

*Primary Examiner*—C. Fred Rosenbaum
*Assistant Examiner*—Gene B. Kartchner
*Attorney, Agent, or Firm*—Andrus, Sceales, Starke & Sawall

[57] ABSTRACT

A pacifier (7) is constructed for a relatively thin generally curved base (8) for conforming to the contour of an infant's face in its mouth and surrounding skin areas. A nipple (12) is suitably attached generally centrally of the base. The base is provided with one or more slots (15) extending inwardly from the base edge (9), with the slots forming tube receiving recesses (16), which may hold one or more feeding and ventilation supply tubes (13, 14) of different sizes. The slots (15*a*) may be substantially larger than a tube (13*a*, 14*a*) passing therethrough, to thus provide a spitup bypass (19). The pacifier is freely releasable from the tubes and will fall away therefrom if the pacifier or tubes are disturbed.

3 Claims, 6 Drawing Figures

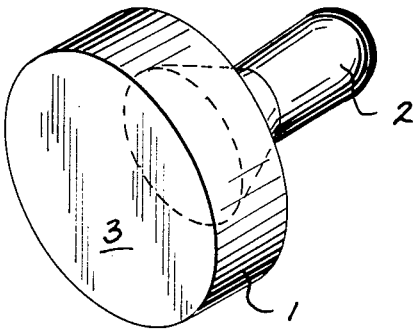
FIG. 1a
PRIOR ART
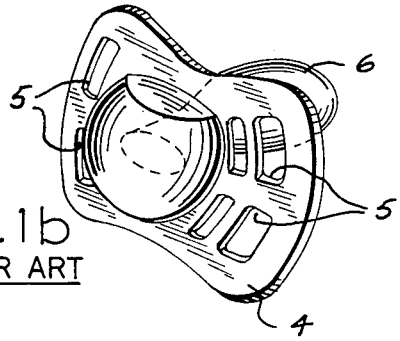
FIG. 1b
PRIOR ART
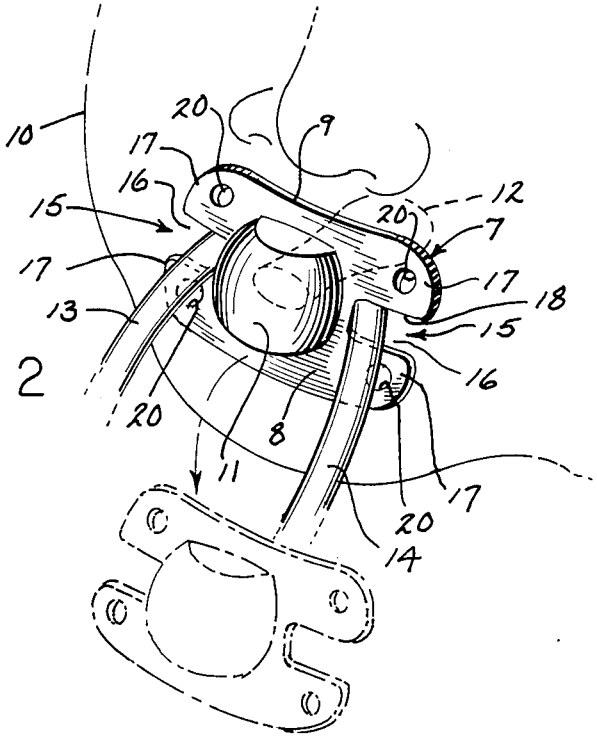
FIG. 2
FIG. 4
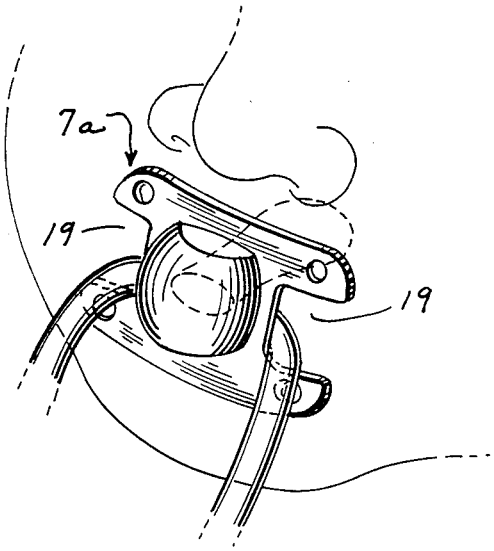
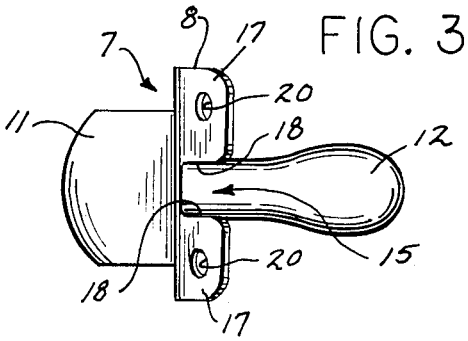
FIG. 3
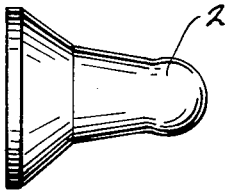
FIG. 5

PACIFIER

BACKGROUND AND SUMMARY OF THE INVENTION

This invention relates to a pacifier, and more particularly to a pacifier for use especially by premature or ill infants who are normally under intensive or other special care in a hospital. Such infants need among other things, food, ventilation and oral stimulation.

For purposes of supplying food continuously and to provide breathing air to the infant, supply tubes are often inserted into the infant's mouth and passed downwardly into the infant's body. For purposes of supplying oral stimulation, pacifiers are used.

Heretofore, a number of different pacifier types have been used. One such type has merely been the usual round bottle cap and perforated nipple, with a backing put on to prevent the infant front sucking air through the nipple. This first type has the advantage of being pre-sterilized when it comes from the manufacturer. A second type has included a special curved base with a non-perforated nipple attached thereto, with the base having a plurality of ventilation holes therein which are disposed inwardly of the base edges and which are disposed about the baby's mouth to aerate the skin and prevent chapping. This second type is not normally supplied in pre-sterilized condition. Additional types of pacifiers are disclosed in the above-identified patents.

It is highly desirable for the infant to be able to have the therapeutic advantages of a pacifier while the infant is being intubated (supplied with food and air via tubes through the mouth). Thus, attempts have been made to use the known pacifiers at the same time that the tubes extend into the infant's mouth. However, problems have arisen with such attempts. As to the above-mentioned bottle cap and nipple type of pacifier, if the pacifier is used at the same time as the tubes, the tubes must pass around behind the outside edge of the cap. If the infant moves or pulls on the pacifier, the supply tubes may tend to be pulled all or partway out of the infant's mouth. As to the above-mentioned second pacifier type, the same thing could occur if the tubes were passed around behind the edge of the base. With this second type, it might be possible to pass one or more tubes through the ventilation holes in the base and into the infant's mouth, but the same problem would occur, and difficulties could arise in threading the tubes through the holes. These pacifiers could also cause problems if the infant somehow otherwise rejects the pacifier, or spits up. Furthermore, if the infant pulls on the tubes, the pacifier can be very easily knocked out of the infant's mouth.

It is an object of the invention to provide a pacifier for infants, and especially for neonate (premature) or ill infants, that can be used at the same time as supply or fluid withdrawl tubes and which will not be subject to the aforementioned diadvantages. It is a further object to provide such a pacifier that can be used in conjunction with tubes of different sizes, and still essentially eliminate the difficulties mentioned above. It is yet another object to provide a pacifier which can be easily pre-sterilized in manufacture, and which prevents chapping of the skin around the infant's mouth.

In accordance with the various aspects of the invention, a pacifier is constructed with a relatively thin generally curved base for conforming to the contour of the infant's face in its mouth and surrounding skin areas.

A nipple is suitably attached generally centrally of the base. The base is provided with one or more slots extending inwardly from the base edge, with the slots forming tube receiving recesses which may hold one or more feeding and ventilation supply tubes of different sizes. The slots may be substantially larger than a tube passing therethrough, to thus provide a spitup bypass. The pacifier is freely releasable from the tubes and will fall away therefrom if the pacifier and/or tubes are disturbed.

BRIEF DESCRIPTION OF THE DRAWINGS

The accompanying drawings illustrate the best mode presently contemplated by the inventor for carrying out the invention.

In the drawings:

FIG. 1*a* is a perspective view of one type of known pacifier;

FIG. 1*b* is a perspective view of another type of known pacifier;

FIG. 2 is a schematic perspective view of a pacifier constructed in accordance with the aspects of the present invention, with the pacifier in use;

FIG. 3 is a side elevation of the pacifier;

FIG. 4 is a view similar to FIG. 2 and showing a slightly modified form of pacifier; and FIG. 5 is an elevational view of a second form of a nipple usable with the pacifier.

DESCRIPTION OF THE PREFERRED EMBODIMENTS

FIGS. 1*a* and 1*b* illustrate previously known types of pacifiers, which have been found to be undesirable when used in combination with supply or other types of tubes which enter an infant's mouth. The pacifier shown in FIG. 1*a* comprises the usual round bottle cap 1 having a perforated nipple 2 attached thereto, with a cover 3 on the back to prevent air from being sucked through the nipple. The pacifier shown in FIG. 1*b* comprises a curved plastic base 4 having a plurality of holes 5 formed therein and disposed inwardly of the base edge. A nipple 6 is suitably attached to base 4. The pacifiers of these two drawing figures are subject to the disadvantages previously discussed.

Referring now to FIGS. 2 and 3, the pacifier 7 of the present invention includes a relative thin plate-like base 8 having a peripheral edge 9 and which may be formed of any suitable material such as plastic, and which is curved to fit the mouth area of an infant 10. In the present embodiment, a support 11 is centrally attached to one side of base 8, and a preferably imperforate nipple 12 is mounted to support 11 and projects through the central base portion for insertion into the infant's mouth.

Pacifier 7 is intended for use in combination with one or more flexible tubes which my be adapted to supply food and air to a neonate infant 10. As shown in FIG. 2, a transpyloric tube 13 may continuously supply liquid sustenance, while an endotracheal tube 14 supplies air for breathing.

In accordance with the various aspects of the invention, pacifier base 8 is provided with means for freely releasably receiving supply tubes 13, 14 therethrough. For this purpose, and in the present embodiment, a plurality of open-ended notches or slots 15 are formed in base edge 9 and extend inwardly into the main body of the base. Slots 15 form tube-receiving recesses 16, each of which may accommodate one or more tubes. The present base 8 is generally H-shaped, forming a pair of legs 17 at each end which define the slot edges 18. In the embodiment of FIGS. 2 and 3, the slot widths as defined by edges 18 are approximately the same as the tube diameters. In the embodiment of pacifier *7a* in FIG. 4, the widths of the slots are substantially greater than the diameters of the tubes, thus providing a spitup bypass space 19. This widening of at least a portion of the slots permits the infant to regurgitate or burp fluid outwardly through the pacifier without disturbing the latter.

Base 8 includes ventillation means to prevent chapping of the infant's skin. As shown, the ventilation means is provided by a plurality of small vent holes 20 in the base. In the present embodiments, holes 20 are disposed in base legs 17.

Referring especially to the phantom line showing of FIG. 2, if infant 10 disturbs pacifier 7, as by pushing on it, the pacifier will merely freely release and fall away from tubes 13 and 14, so that the tubes slide out of the slots and remain generally undisturbed. Likewise, if the infant pulls on or otherwise disturbs the tubes, it may not cause the pacifier to be pulled from the infant's mouth; but if it does, the pacifier will merely drop away.

FIG. 5 illustrates another form of nipple 21 which has been found to be advantageous when used in the pacifier of the present invention, and especially for premature or ill infants.

The concepts of the present invention provide a relatively simple but yet unique pacifier which can give an infant oral gratification at the same time as food and ventilation are being supplied; and without the previously discussed problems. The pacifier is simple and economical to manufacture, and may be presterilized if desired.

Various modes of carrying out the invention are contemplated as being within the scope of the following claims particularly pointing out and distinctly claiming the subject matter which is regarded as to the invention.

I claim:

1. An infant pacifier (7) for use independent of but along side nonremovable tubes (13, 14) supplying air and food for insertion into an infant's body through its mouth, said pacifier comprising:

(a) a base (8) having a generally peripheral edge (9), said base being adapted to symmetrically engage an infant's face in its mouth area, (b) a nipple (6) attached to said base, (c) and a pair of opposed slots (15) disposed in said base and extending into said base from said peripheral edge, (d) said slots comprising recesses (16) through which said tubes go into the mouth for unrestricted air and food supply, and with said slots being formed in a manner so that said pacifier is freely releasable from said tubes at all positions of the tubes within said slots and falls away from the tubes if said pacifier and/or tube means are disturbed.

2. The infant pacifier of claim 1 in which the width of said slots (15) throughout their inward extent is greater than the diameter of supplied tubes.

3. The infant pacifier of claim 2 in which said base (8) is generally H-shaped and forms a pair of legs (17) at each end, each said leg pair in turn forming one of said opposed slots (15).

* * * * *

UNITED STATES PATENT AND TRADEMARK OFFICE

CERTIFICATE OF CORRECTION

PATENT NO. : 4,715,379

DATED : December 29, 1987

INVENTOR(S) : Mary D. McCormick

It is certified that error appears in the above-identified patent and that said Letters Patent is hereby corrected as shown below:

IN THE ABSTRACT

Line 1, delete "for" and insert ---with---

IN THE SPECIFICATION

Column 2, line 27, after second occurrence "of" delete "a"
line 57, delete "my" and insert ---may---

IN THE CLAIMS

Claim 1, column 4, line 26, delete "means" and insert ---tubes---

Signed and Sealed this

Thirty-first Day of May, 1988

*Attest:*

*Attesting Officer*

DONALD J. QUIGG

*Commissioner of Patents and Trademarks*